US005294271A

United States Patent [19]

Suzaki et al.

[11] Patent Number: 5,294,271

[45] Date of Patent: Mar. 15, 1994

[54] HEAT TREATMENT FOR MANUFACTURING SPRING STEEL EXCELLENT IN HIGH-TEMPERATURE RELAXATION RESISTANCE

[75] Inventors: Tsunetoshi Suzaki; Tomoyoshi Iwao, both of Hiroshima; Teruo Tanaka, Tokyo; Toshiro Yamada, Osaka, all of Japan

[73] Assignee: Nisshin Steel Co., Ltd., Tokyo, Japan

[21] Appl. No.: 3,745

[22] Filed: Jan. 13, 1993

Related U.S. Application Data

[63] Continuation-in-part of Ser. No. 715,253, Jun. 14, 1991, abandoned.

[51] Int. Cl.[5] ..... C21D 9/02

[52] U.S. Cl. ..... 148/580; 148/624; 148/654; 148/506

[58] Field of Search ..... 148/580, 624, 654, 506

[56] References Cited

U.S. PATENT DOCUMENTS

| | | | |
|---|---|---|---|
| 4,174,981 | 11/1979 | Cassell | 148/580 |
| 4,196,025 | 4/1980 | Davies | 148/334 |
| 4,407,681 | 10/1983 | Ina et al. | 148/570 |
| 4,673,433 | 6/1987 | Roberts | 148/547 |

FOREIGN PATENT DOCUMENTS

| | | |
|---|---|---|
| 51-2616 | 1/1976 | Japan . |
| 58-167728 | 10/1983 | Japan . |
| 187652 | 9/1985 | Japan . |
| 2-240240 | 9/1990 | Japan . |

*Primary Examiner*—R. Dean
*Assistant Examiner*—Sikyin Ip
*Attorney, Agent, or Firm*—Nikaido, Marmelstein, Murray & Oram

[57] ABSTRACT

The high-temperature relaxation resistance of spring steel is improved by providing a specified composition of the steel, and subjecting that steel composition to a controlled heat treatment. The high-temperature relaxation resistance, which can not be estimated from the mechanical properties (e.g. strength and hardness) of steel materials at an ordinary temperature, is improved by these conditions which the inventors have found out from many experiments. Especially, the temper-softening resistance is enhanced by an increase of the Si content. The density of dislocation is lowered by providing fine carbides ($MO_2C$) serving as inhibitors for the migration of dislocation. These are precipitated by a controlled heat treatment without reducing hardness in the tempered state. Consequently, the obtained spring steel can be used operated in a high-temperature environment for a long time without a deterioration in its properties.

12 Claims, 3 Drawing Sheets

| Mark | Steel | Annealing Temp. | Av. Particle Size. of Carbide |
|---|---|---|---|
| ○ | A−18 | 650 ℃ | 1.2 μm |
| △ | A−18 | 700 ℃ | 1.6 μm |
| □ | A−18 | 750 ℃ | 2.5 μm |
| ⬡ | B−18 | 700 ℃ | 1.5 μm |

HEAT TREATMENT FOR MANUFACTURING SPRING STEEL EXCELLENT IN HIGH-TEMPERATURE RELAXATION RESISTANCE

This application is a continuation-in-part of application Ser. No. 07/715,253 filed Jun. 14, 1991, now abandoned. The entire contents of which are incorporated herein by reference.

BACKGROUND OF THE INVENTION

The present invention relates to a method of manufacturing a spring steel having improved in relaxation resistance at a high temperature. The spring steel is particularly useful as a diaphragm spring in the clutch of a motor vehicle to be operated at a high temperature.

In recent years, springs used in machines are exposed to a higher temperature environment which is caused by an increase of the output power and/or the scale enlargement of the machine. For instance, a diaphragm spring incorporated in a clutch or the like was, at one time, heated up to 150° C. at the highest. As a torque applied to a clutch becomes larger due to an increase of the engine power of a motor vehicle, such as a four-wheel drive vehicle, the environmental temperature of the clutch has become raised up to 250°-350° C., i.e. a warm temperature range from a metallurgical point of view.

A steel spring, which exhibits sufficient property at ambient temperatures, is easily relaxed when it is exposed to such a high temperature environment. Consequently, the property necessary for the spring to act in its intended capacity is rapidly deteriorated. In this regard, the demand for the property of the spring becomes severer. Such demand is not only for a diaphragm spring in the clutch of a motor vehicle but also for other disc springs to be incorporated in other machines with as a function of the increase of output power.

A carbon tool steel such as SK5 (JIS:Japanese Industrial Standard) has been used as the material of a diaphragm spring in a conventional motor vehicle, since it has sufficient relaxation resistance at a temperature below 150° C. However, a diaphragm spring made of the carbon tool steel is rapidly relaxed and becomes inoperative when the environment in which the spring operates is heated to a high temperature (such as 250°-350° C.). Consequently, there has risen a requirement for the development of a steel which exhibits excellent relaxation resistance sufficient to operate at an elevated temperature. In addition, the steel shall have a fatigue strength which is high enough to endure the repetition of applications of load without breaking.

It is well known that an increase of Si content is effective for improving the relaxation resistance of the steel material. For instance, a high-Si steel such as SUP6 or SUP7, defined in JIS G4801, has been used as a spring material which is required to have substantial relaxation resistance. On the other hand, it is known that the quenchability of steel is enhanced by the addition of Mo in combination with increases of the Si and Mn contents, as disclosed in Japanese Patent Publication Laid-Open 2-240240.

Steels such as SUP6 and SUP7, containing large amounts of Si, exhibit excellent relaxation resistance at ambient temperatures. However, their relaxation resistance is reduced with an increase of the environmental temperature, so that a spring made of such steel does not exhibit sufficient property at the elevated temperature (250°-350° C.).

By the way, a quenching-tempering treatment has been applied to a spring steel to obtain the property necessary for its use in springs. If the steel material is held at a high temperature for a long time in advance of quenching in this heat treatment, it is decarburized and oxidized at its grain boundaries. As a result, the fatigue strength of the obtained steel spring is lowered, so that the steel spring would not bear the repetition of load. In order to maintain the fatigue strength at a proper level, carbides need to be rapidly dissolved in the matrix which is being transformed into an austenitic state during the heat treatment.

The relaxation resistance of steel is also improved by heat treatment, e.g. quenching, tempering, applying plastic strain, and then strain aging at 250°-350° C. However, since this heat treatment requires a number of steps, manufacturing costs of steel springs become higher. In this consequence, there is a need for a steel material which, as such in a quench-tempered state exhibits excellent relaxation resistance at high temperatures.

SUMMARY OF THE INVENTION

An object of the present invention is to provide a steel material useful as a diaphragm spring or the like to be operated at an elevated temperature.

Another object of the present invention is to provide a spring steel having a martensite structure wherein fine carbides are effectively precipitated to reduce movable dislocation density and to inhibit dislocation migration.

Still another object of the present invention is to transform the metallurgical structure of the steel to a martensite phase by a specified heat treatment which causes neither decarburization nor intergranular oxidation. The high-temperature relaxation resistance of a steel can not be estimated from the properties, e.g. hardness or tensile strength, of the steel at an ambient temperature. According to the present invention, the density of dislocation is lowered by the specified composition and the controlled heat treatment, and the dislocation migration is suppressed by the precipitation of fine $MO_2C$ carbide particles serving as an inhibitor. The lowered dislocation density and the inhibition of dislocation migration make the metallurgical structure of the steel stable at a high temperature, resulting in its improvement of the high-temperature relaxation resistance.

Fatigue strength, in addition to relaxation resistance, is one of the most important properties for spring steels. The fatigue strength largely depends on tensile strength. The surface condition of the steel sheet also affects the fatigue strength. When the steel is quenched and tempered, its fatigue strength is much varied by the degree of decarburization during heating associated with the solution treatment.

The promotion of decarburization is changed according to the chemical composition of the steel and the condition required for transforming the steel to austenite. The austeniting condition is determined so as to heat the steel at a high temperature for a time period sufficient for dissolving carbides in the austenite matrix. In this sense, the chemical composition of the steel and the particle size of carbides have influences on the conditions needed to convert to austenite. In order to improve the fatigue strength, it is necessary to control the particle size of carbides by the chemical composition of the steel, as well as by the cold-rolling and annealing conditions, etc., in a manner such that decarburization does not occur during solution treatment.

The steel to be used in the present invention consists essentially of, each by weight, 0.4–0.8% C, 0.5–2.5% Si, 0.3–2.0% Mn, 0.1–1.5% Cr, 0.1–0.5% Mo, with the balance being Fe except inevitable impurities. In particular, a Si content within the range of 1.5–2.5% is preferable. The steel may contain 0.05–0.5% of one or both of V and Ni, to inhibit the growth of austenite particles into coarse grains and to improve relaxation resistance at elevated temperatures.

Si and Cr contents preferably satisfy the relationship defined by the equation: $7 \leqq 4 \times Si(\%) - 10 \times Cr(\%) \leqq 5$.

Al as an impurity is preferably controlled at 0.020% or less to reduce the formation of hard inclusions such as $Al_2O_3$ which would act as starting points to develop fatigue failure. Hereby, the steel is hardened without lowering fatigue strength.

This steel composition in the present invention is adjusted so as to facilitate the precipitation of fine carbide particles during tempering. The defined steel composition is effective in the enhancement of temper softening resistance, too.

The steel is hot rolled and annealed. The annealed steel sheet is then subjected to at least one cold rolling step comprising rolling at a reduction of 10–80% and annealing at a temperature, e.g. 550°–730° C., below its $Ac_1$ transition point. The steel sheet after being cold rolled has a structure wherein carbides are precipitated as fine spheroidal particles, preferably of 2 μm or less in average particle size. The steel sheet is then subjected to solution treatment at a temperature, above its $Ac_3$ transition point, for a time sufficient to completely dissolve the spheroidal carbide particles in the austenite matrix.

The steel sheet is then quenched, i.e. rapidly cooled at a cooling speed higher than its lowest critical cooling speed. The steel sheet, after being quenched, is in a state oversaturated with carbon. The lowest critical cooling speed means a cooling speed above which the austenite phase is completely transformed to martensite. If the cooling speed is below the lowest critical cooling speed, the austenite phase is partially transformed to bainite or pearlite.

The quenched steel sheet is heated again, i.e. tempered, at a temperature within the range of 450°–600° C. for a time sufficient to precipitate carbides as fine particles. This tempering treatment is performed at a temperature higher than the usual tempering temperature to accelerate the precipitation of fine particles, particularly fine carbides, such as $MO_2C$. The finely precipitated carbides serve as inhibitors against dislocation migration which would cause high-temperature relaxation. The steel sheet is then cooled to room temperature. The obtained steel sheet has a hardness of about HV 400–550 due to the precipitation of fine carbides.

The other objects and features of the present invention will be understood from the following description with reference to the drawings attached.

DETAILED DESCRIPTION OF THE PREFERRED EMBODIMENT

Figure 1:
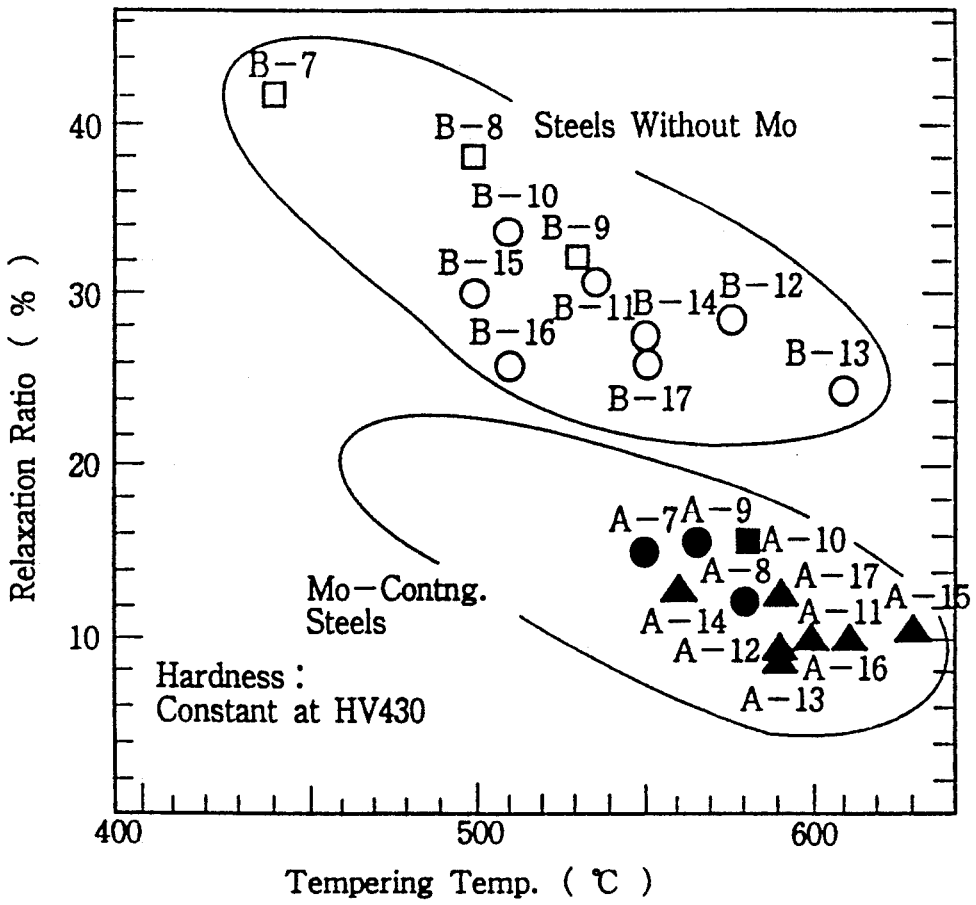
FIG. 1 is a graph showing the relationship between the tempering temperature needed to obtain a temper hardness of HV 430 and the relaxation ratio.

We have searched and investigated what kinds of influence alloying elements and manufacturing conditions exhibit on the high-temperature relaxation resistance of steel and repeated a lot of experiments.

The high-temperature relaxation, which can not be estimated from hardness and tensile strength at an ambient temperature, has been considered as the phenomenon wherein plastic deformation is promoted as a function of the time elapsed at high temperature. For instance, when a steel material is held in a state where deformation is continuously applied under a constant strain or deflection, the plastic deformation of the steel gradually advances. As a result, permanent deformation becomes larger, or strength is lowered at a certain point. In the point of microscopic view, the relaxation is caused by the migration of dislocation. In this regard, the means (1) to (3) under-mentioned are necessary for the inhibition of this high-temperature relaxation.

(1) To render a steel material into a state which is stable under a high-temperature condition (2) To reduce the density of dislocation in the steel material (3) To inhibit the migration of dislocation introduced into the steel material The addition of Si in a controlled amount enhances the temper-softening resistance of the steel material, makes the steel material stable under the high-temperature condition (1) and reduces the density of dislocation (2). The addition of Mo in a controlled amount effectively inhibits the migration of dislocation (3).

The migration of dislocation is further suppressed by heat treatment whereby $MO_2C$ is precipitated as fine particles in the steel matrix. The carbide ($MO_2C$) particles, which are effective in the inhibition of the dislocation migration, are precipitated by tempering the steel at a proper temperature. If a quenched steel material is tempered at an excessively high temperature, the carbide is precipitated as coarse grains which does not inhibit the migration of dislocation.

In short, we have found that the precipitation of fine carbides such as $MO_2C$ in a steel containing proper amounts of C, Si, Mn, Cr, Mo etc., effectively inhibits the migration of dislocation which would cause high-temperature relaxation. In addition, the density of initial dislocation is preferably lowered by controlling a tempering temperature so as to provide the steel material with controlled temper hardness. Thus, the steel after being tempered exhibits excellent high-temperature relaxation resistance compatible with fatigue strength.

The favorable carbide precipitation is preferably attained by controlling the steel composition as well as the conditions of heat treatment. Carbides in the steel are controlled to spheroidal particles by cold rolling and annealing, so as to facilitate the dissolution of the carbides in the austenite matrix during solution treatment. The steel after being quenched becomes oversaturated with the dissolved carbon.

The dissolved carbon is re-precipitated as carbides ($MO_2C$) by tempering the steel at a temperature within the specified temperature range. The re-precipitated carbides are fine particles effective in the improvement of high-temperature relaxation resistance.

We have found from many experiments that excellent high-temperature relaxation resistance can be obtained by the reduction of dislocation migration and the precipitation of fine carbides. When steels, after being tempered, exhibit the same strength, tempering at a higher temperature within the range below about 600° C. reduces the density of dislocation, especially movable dislocation which would move in response to the application of strain at a high temperature.

In order to attain the reduction of dislocation density and the precipitation of fine carbides at the same time, the steel composition is determined, and the steel is tempered at a temperature higher than the usual tempering temperature for conventional steels, such as SK5. The steel being tempered is prevented from softening by the specified steel composition. The specified steel composition is effective for providing the steel with the strength necessary for use as a spring, too.

The steel according to the present invention contains Si in an increased amount to assure the hardness necessary for spring steel after being tempered at a temperature higher than the usual tempering temperature. The presence of the element Si effectively improves the resistance of the steel to temper softening.

The increase of Si content would be expected to cause the precipitation of graphite particles and oxidation at grain boundaries. The graphite precipitation and the intergranular oxidation are however, inhibited by the addition of Cr. The alloying element Cr effectively improves the quenchability of the steel, too.

The element Cr, however, is likely to be concentrated in spheroidal carbide particles, so that the dissolution of carbides during solution treatment would occur at a significantly low speed. This harmful Cr effect may be suppressed by controlling the Cr content in consideration of the Si content according to the equation of:

$$-7 \leqq 4 \times Si\ (\%) - 10 \times Cr(\%) \leqq 5$$

The relationship between the Si and Cr contents is effective for making the quenchability of the steel compatible with the high-temperature relaxation resistance.

When the element Mo is added to the steel under the high-Si and Cr-added condition, $MO_2C$, effective as an inhibitor against dislocation migration, is precipitated in a martensite matrix after being tempered. Thus, the steel is improved in high-temperature relaxation resistance. The precipitation of $MO_2C$ is assured by tempering the steel at a temperature above about 450° C.

The optional elements V and Nb are also precipitated as carbides effective for inhibiting the dislocation migration. In addition, the growth of the austenite phase to coarse grains is inhibited by the addition of V and/or Nb. In order to improve the high-temperature relaxation resistance by the addition of Mo, V and Nb, these alloying elements shall be dissolved in the steel matrix when the steel is heated at a temperature above its $Ac_3$ transition point during solution treatment. The dissolution of the alloying elements is assured by cold rolling and annealing the steel sheet, whereby the carbides of the alloying elements are reformed to fine spheroidal particles.

It is well known that a decarburizing reaction violently occurs in the surface layer of a steel material as a function of the increase of Si content. Since the steel in the present invention contains a large amount of Si to improve high-temperature relaxation resistance, the steel shall be quenched at a relatively lower temperature in a short time to inhibit the decarburizing reaction. In order to obtain proper quenchability under this condition, carbide particles in the steel after being cold rolled and then annealed are preferably adjusted to 2 μm or less in average particle size. Thereby, various properties necessary for spring steels can be achieved in the high-Si steel.

Each alloying element in this spring steel has the effect undermentioned:

C is an alloying element effective for enhancing the strength of the steel. The amount of C shall be 0.4% or more to obtain the strength necessary for a spring. However, the upper limit of the C content has been determined to be 0.8%, otherwise the steel would be in a state which is easily cracked during quenching and has insufficient toughness.

Si is an important alloying element effective for ensuring the strength necessary for a spring as well as enhancing temper softening resistance when the steel is heated at a temperature higher than the usual tempering temperature for carbon tool steel. In this regard, the steel contains Si in an amount 0.5% or more, preferable 1.5% or more. However, during heat treatment, an excessive amount of Si accelerates intergranular oxidation and decarburization, which would cause harmful influences on the properties of the steel necessary for a spring. Besides, graphite particles would be easily precipitated during hot rolling and/or annealing. In order to inhibit these defects, Si content is controlled at 2.5% or less.

Mn is effective in deoxidizing a steel melt and in improving the quenchability of the steel. The steel shall contain 0.3% or more Mn, to ensure the Mn effect. However, the toughness of the steel after being quench-tempered would be substantially lowered with an increase of Mn content above 2.0%. Besides, an increase of Mn content causes the lowering of the steel's Ms transition point, so that the steel could not be completely transformed into a martensite phase. In this regard, the upper limit of Mn content is controlled at 2.0%.

The addition of Cr effectively inhibits the precipitation of graphites and intergranular oxidation which would easily occur due to the increased amount of Si. The alloying element Cr is effective in improving the quenchability of the steel, too. These effects are ensured by adding Cr in an amount of 0.1% or more under the condition satisfying the equation:

$-7 \leqq 4 \times Si\ (\%) - 10 \times Cr\ (\%) \leqq 5$ to assure the toughness of the quench tempered steel and to prevent the concentration of Cr in spheroidal graphite particles formed during annealing.

Mo is reacted with C existent in the steel after being cold rolled and annealed. The resulting reaction product $Mo_2C$ is dissolved in an austenite matrix, when the steel is heated at a temperature above its $Ac_3$ point during solution treatment. After the steel is transformed to a martensite phase by quenching, the dissolution of $Mo_2C$ is maintained as such in the martensite phase. Mo dissolved in the martensite phase is precipitated, as fine $MO_2C$ particles, when the quenched steel is tempered at a temperature of 450°-600° C.

The high-temperature relaxation resistance of the steel is remarkably enhanced by the precipitation of the fine carbide ($MO_2C$) particles. Thus, Mo is the most important alloying element for improving the property of the steel.

The Mo effect is obtained by the addition of Mo in an amount of 0.1% or more. However, the addition of Mo in an excessive amount above 0.5% causes the formation of coarse carbide particles which are hardly dissolved in the austenite matrix during solution treatment at a temperature above the $Ac_33$ point. Undissolved carbides exhibit the same effect as that of nonmetallic inclusions, which is to reduce the fatigue strength of the steel. In this regard, Mo content is limited to 0.5% or less.

An optional element V and/or Nb is also formed into its carbide in the steel after being cold rolled and annealed. When the steel is heated at a temperature above its $Ac_3$ transition point, the carbides of V and Nb are partially dissolved in the austenite matrix. The dissolved V and/or Nb are precipitated as fine carbide particles in the same way as that is the $MO_2C$, resulting in the improvement of the high-temperature relaxation resistance. On the other hand, carbides undissolved in the austenite matrix serve as an inhibitor to suppress the growth of the austenite phase to coarse grains.

These effects are ensured by the addition of V and/or Nb in an amount of 0.05% or more. However, the addition of V and/or Nb in an excessive amount above 0.5% causes an increase of the amount of coarse carbide particles. The coarse carbide particles would be hardly dissolved in the austenite matrix when the steel is heated at a temperature above its $Ac_3$ point during the solution treatment. As a result, the coarse carbide particles would exhibit the same effect as that of nonmetallic inclusions, that is to reduce the fatigue strength of the steel. In this regard, the steel may contain V and/or Nb in an amount not more than 0.5%.

A steel spring is subjected to the repetition of bending or torsion fatigue during use. This kind of fatigue is unfavorably affected by hard inclusions such as $Al_2O_3$. When Al content is controlled below 0.020%, the fatigue strength of the steel is maintained at a high level while inhibiting the effect of $Al_2O_3$.

The steel having the composition as above-mentioned is hot rolled, annealed, cold rolled and then quench-tempered to obtain the strength necessary for use as a spring. In the quench-tempering treatment, the steel is transformed into an austenite phase by heating it at a temperature above its $Ac_3$ transition point, rapidly cooled and then tempered. The conditions of the quench-tempering treatment are controlled so that the steel after being tempered preferably has a hardness of HV 400–550. If the hardness is below about HV 400, the steel would be insufficient of strength and easily plastically deformed by the application of stress. Consequently, the steel can not be used as a steel spring. On the other hand, the steel having a hardness above HV 550 would be too sensitive to notches and lack of fatigue strength. As a result, there would often occur fatigue failure originated in minute defects, such as flaws or inclusions, which were inevitably applied to the surface layer of the steel sheet.

After the steel sheet is hot rolled and annealed, it is cold rolled with a rolling reduction of 10–80%. If the rolling reduction is below 10%, carbides would grow to coarse particles, but not finely divided particles, during annealing at a temperature below its $Ac_3$ transition point in the following step. Besides, it would take a long time to dissolve carbides in an austenite matrix when the steel is heated at a temperature above its $Ac_3$ transition point during solution treatment. The long time heating causes the decarburization of the steel and the formation of a coarse austenite phase. Consequently, the property required for spring steel would be deteriorated. On the other hand, the cold-rolled steel sheet would be significantly work hardened with the increase of the rolling reduction above 80%. The work hardening causes the formation of defects such as edge cracks.

The cold rolled steel sheet is preferably annealed at a temperature of 550°–730° C. If the steel sheet is heated at a temperature above 730° C. the spheroidal carbides would become coarse. Consequently, it would take a long time to dissolve the carbides in the austenite matrix during solution treatment, resulting in the promotion of decarburization causing the deterioration of spring property. On the contrary, if the annealing temperature is below 550° C., the ferritic phase work hardened by the preceding cold rolling would not be sufficiently recovered so that the hardness of the annealed steel would be held at higher level. Consequently, the annealed steel sheet would exhibit poor formability.

Carbides precipitated in the annealed steel are preferably of 2 μm or less in average particle size. The fine carbide particles are easily dissolved in the austenite matrix during the solution treatment. In this regard, the conditions of cold rolling and annealing are selected to make the particle size of the carbides smaller than about 2 μm.

The annealed steel is then quench-tempered to obtain the strength necessary for steel spring.

At first, the steel is solution treated, e.g. being held at a temperature above its $Ac_3$ transition point for a time sufficient to dissolve spheroidal carbide particles in the austenite matrix. The steel is quenched, e.g. being rapidly cooled at a lower critical cooling speed, to completely transform the austenite matrix to a martensite phase oversaturated with the dissolved carbon.

Thereafter, the steel is tempered, e.g. being heated at a temperature of about 450°–600° C. for a time sufficient to re-precipitate fine carbides in the martensite matrix. Carbides such as $MO_2C$, VC and NbC effective in the high-temperature relaxation resistance start re-precipitation when the steel is heated to a temperature of about 450 ° C. or higher. However when the tempering temperature exceeds about 600° C., the re-precipitated carbides become coarse. The coarse carbide particles are ineffective for inhibiting the migration of dislocation, so that the high-temperature relaxation resistance would be deteriorated. Besides, the strength of the tempered steel would become lower.

As above-mentioned, spring steel which is excellent in high-temperature relaxation resistance is obtained by the specified steel composition in combination with the controlled condition of the heat treatment.

EXAMPLE 1

Effect of Cold Rolling Reduction

Steels used in this example had compositions shown in Table 1. In Table 1, the group-A steels have the chemical compositions within the range of the present invention, while the group-B steels are for comparison.

TABLE 1

STEEL COMPOSITIONS USED IN EXAMPLE

| STEEL KINDS | CHEMICAL COMPOSITION (wt. %) | | | | | | | | |
|---|---|---|---|---|---|---|---|---|---|
| | C | Si | Mn | P | S | Cr | Mo | V | Nb |
| A-1 | 0.58 | 1.65 | 0.73 | 0.011 | 0.008 | 0.95 | 0.21 | tr. | tr. |
| A-2 | 0.61 | 1.69 | 0.73 | 0.012 | 0.006 | 0.97 | 0.22 | 0.22 | tr. |
| A-3 | 0.59 | 1.66 | 0.73 | 0.010 | 0.007 | 0.96 | 0.22 | tr. | 0.19 |
| A-4 | 0.62 | 1.65 | 0.75 | 0.012 | 0.007 | 0.95 | 0.21 | 0.21 | 0.11 |
| A-5 | 0.64 | 1.71 | 0.82 | 0.016 | 0.009 | 0.72 | 0.31 | 0.24 | 0.21 |
| A-6 | 0.72 | 2.21 | 1.52 | 0.015 | 0.008 | 0.74 | 0.42 | 0.31 | 0.22 |
| B-1 | 0.32 | 1.62 | 0.74 | 0.014 | 0.009 | 0.95 | 0.23 | tr. | tr. |
| B-2 | 0.92 | 1.64 | 0.77 | 0.015 | 0.008 | 0.92 | 0.22 | 0.01 | tr. |
| B-3 | 0.62 | 0.21 | 0.81 | 0.013 | 0.006 | 0.93 | 0.21 | tr. | tr. |
| B-1 | 0.59 | 1.61 | 0.21 | 0.013 | 0.008 | 0.92 | 0.21 | 0.22 | tr. |
| B-2 | 0.62 | 1.72 | 0.80 | 0.012 | 0.006 | 0.02 | 0.21 | 0.02 | tr. |
| B-3 | 0.62 | 1.59 | 0.71 | 0.011 | 0.008 | 0.92 | 0.01 | tr. | 0.01 |

Each of the steels A-1 and A-6 was formed to a sheet of 3.5 mm in thickness by conventional hot rolling, annealed and then cold rolled with a reduction of 5-90%. The steel sheet was annealed at a temperature of 700° C., below its $Ac_1$ transition point, for 10 hours. Thereafter, the steel sheet was soaked at a temperature of 900° C., above its $Ac_3$ transition point, for a time 1 on 8 enough to reduce the proportion of residual carbides to below 1 wt. %, and then quenched in oil.

The formation of edge cracks in the cold rolled steel sheet was investigated. The depth of a decarburized layer in the steel after being quenched was measured. The results are shown in Table 2.

TABLE 2

EFFECTS OF CONDITIONS OF COLD ROLLING AND HEAT TREATMENT

| STEEL KIND | ROLLING REDUCTION | FORMATION OF EDGE CRACKS | ANNEALING TEMP. | QUENCHING TEMP. | DEPTH OF DECARBURIZATION |
|---|---|---|---|---|---|
| A-1 | 5% | no | 700° C. | 900° C. | 6.1 μm |
| | 15 | no | 700 | 900 | 3.1 |
| | 30 | no | 700 | 900 | 2.1 |
| | 70 | no | 700 | 900 | 1.2 |
| | 90 | do | — | — | — |
| A-6 | 5 | no | 700 | 900 | 7.2 |
| | 15 | no | 700 | 900 | 3.4 |
| | 40 | no | 700 | 900 | 2.2 |
| | 70 | no | 700 | 900 | 1.3 |
| | 90 | do | — | — | — |

It is noticed from Table 2 that edge crack occurred when the steel sheet was cold rolled at a reduction above 80%. On the other hand, when the rolling reduction was less than 10%, the decarburized layer was remarkably deeper. This is caused by the fact that carbides in the steel after being rolled with a small reduction below 10% became coarse particles which required a long solution treatment time to dissolve in the austenite matrix.

EXAMPLE 2

Effect of Heat Treatment

Each of the group-A and group-B steels was formed into a sheet of 3.5 mm in thickness by hot rolling and then subjected to conventional annealing. The annealed steel sheet was cold rolled to thickness of 2.3 mm at a reduction of 35%, and annealed at 700° C. for 10 hours. The annealed steel sheet was heated at a temperature of 850°-900° C., above its $Ac_3$ transition point, for 10 min., quenched in oil and then tempered at a temperature of 420°-630° C. for 30 min..

The heat treated steel sheet was subjected to a relaxation test to evaluate its resistance to high-temperature relaxation. In the relaxation test, a test piece was held at 350° C. for 12 hours under the condition that an initial strain of 1.0% was applied. Load reduction after the test was regarded as relaxation ratio. Table 3 shows the results of the relaxation test.

TABLE 3

EFFECTS OF HEAT TREATMENT ON PROPERTY OF STEEL

| STEEL KIND | QUENCHING TEMP. (°C.) | TEMPERING TEMP. (°C.) | HARDNESS (HV) | RELAXATION RATIO (%) | NOTE |
|---|---|---|---|---|---|
| A-1 | 900 | 480 | 495 | 16.2 | PRESENT |
| | 900 | 520 | 475 | 15.1 | INVENTION |
| | 900 | 560 | 452 | 14.4 | |
| | 850 | 520 | 462 | 15.7 | |
| A-2 | 900 | 560 | 470 | 13.5 | |
| A-3 | 900 | 520 | 479 | 15.7 | |
| A-4 | 900 | 480 | 513 | 14.2 | |
| | 900 | 520 | 492 | 13.4 | |
| | 900 | 560 | 468 | 12.6 | |
| | 850 | 560 | 452 | 13.2 | |
| A-5 | 900 | 560 | 453 | 14.1 | |
| A-6 | 900 | 580 | 472 | 11.1 | |
| B-1 | 900 | 520 | 348 | 40.2 | COMPARATIVE |

TABLE 3-continued

| EFFECTS OF HEAT TREATMENT ON PROPERTY OF STEEL | | | | | |
|---|---|---|---|---|---|
| STEEL KIND | QUENCHING TEMP. (°C.) | TEMPERING TEMP. (°C.) | HARDNESS (HV) | RELAXATION RATIO (%) | NOTE |
| B-2 | 900 | 560 | 473 | 20.1 | EXAMPLE I |
| B-3 | 880 | 520 | 394 | 25.2 | |
| B-4 | 900 | 520 | 442 | 18.2 | |
| B-5 | 900 | 560 | 421 | 21.7 | |
| B-6 | 880 | 520 | 427 | 32.5 | |
| A-1 | 900 | 420 | 567 | 21.5 | COMPARATIVE |
| | 900 | 630 | 413 | 19.2 | EXAMPLE II |
| A-4 | 900 | 420 | 591 | 20.1 | |
| | 900 | 630 | 426 | 18.1 | |
| A-6 | 900 | 420 | 625 | 19.5 | |
| | 900 | 630 | 513 | 17.3 | |

Since C content in the comparative steel B-1, Si content in the comparative steel B-3, Mn content in the comparative steel B-4 and Cr content in the comparative steel B-5 were respectively lower than the contents of those elements required to satisfy the range of the present invention, these comparative steels had lower strengths and higher relaxation ratios. Although the comparative steel B-2 contained a large amount of C, its relaxation ratio was not largely reduced. The comparative steel B-6 exhibited very high relaxation ratio, since it did not contain Mo.

When each of the group-A steels, which had compositions within the range required by the present invention, was tempered at a temperature out of the range of the present invention, the relaxation ratio was not largely reduced (see COMPARATIVE EXAMPLE II in Table 3). This means that the reduction of relaxation ratio was not only determined by the steel composition, but also by the conditions of heat treatment.

On the other hand, when quenching temperature and tempering temperature of all the steel compositions within the range of the present invention was correct, the relaxation ratio was remarkably reduced (see EXAMPLE in Table 3). Consequently, it is apparent that the steel obtained according to the present invention was excellent in high-temperature relaxation resistance.

EXAMPLE 3

Effect of Mo on Relaxation

Each of the steels shown in Table 4 was hot rolled to a sheet of 3.5 mm in thickness, annealed and then cold rolled at a reduction of 35%. The obtained cold-rolled steel sheet was of 2.3 mm in thickness. In Table 3, the group-A steels have chemical compositions within the range of the present invention, while the group-B steels are comparative.

TABLE 4

| STEELS USED IN EXAMPLE | | | | | | | | | | |
|---|---|---|---|---|---|---|---|---|---|---|
| | CHEMICAL COMPOSITIONS (wt. %) | | | | | | | | | |
| STEEL KIND | C | Si | Mn | P | S | Cr | Mo | V | Nb | Al |
| A-7 | 0.58 | 1.15 | 0.53 | 0.010 | 0.006 | 0.95 | 0.21 | tr. | tr. | 0.008 |
| A-8 | 0.61 | 1.16 | 0.53 | 0.008 | 0.007 | 0.97 | 0.22 | 0.22 | tr. | 0.012 |
| A-9 | 0.67 | 1.04 | 1.02 | 0.006 | 0.005 | 1.16 | 0.15 | tr. | tr. | 0.010 |
| A-10 | 0.61 | 0.90 | 1.12 | 0.008 | 0.006 | 0.90 | 0.25 | tr. | 0.10 | 0.012 |
| A-11 | 0.60 | 2.00 | 0.48 | 0.009 | 0.005 | 0.87 | 0.21 | tr. | tr. | 0.015 |
| A-12 | 0.59 | 2.00 | 0.50 | 0.012 | 0.004 | 0.72 | 0.23 | 0.07 | tr. | 0.018 |
| A-13 | 0.60 | 2.00 | 0.51 | 0.012 | 0.005 | 0.52 | 0.20 | 0.08 | 0.07 | 0.014 |
| A-14 | 0.60 | 1.80 | 0.70 | 0.010 | 0.007 | 0.50 | 0.11 | tr. | tr. | 0.012 |
| A-15 | 0.72 | 2.21 | 0.50 | 0.011 | 0.007 | 0.91 | 0.20 | tr. | tr. | 0.014 |
| A-16 | 0.71 | 1.90 | 0.50 | 0.011 | 0.006 | 0.52 | 0.20 | tr. | tr. | 0.014 |
| A-17 | 0.73 | 2.10 | 0.52 | 0.012 | 0.006 | 0.51 | 0.11 | 0.07 | tr. | 0.018 |
| B-7 | 0.72 | 0.23 | 0.81 | 0.013 | 0.008 | 0.07 | tr. | tr. | tr. | 0.018 |
| B-8 | 0.82 | 0.25 | 0.50 | 0.012 | 0.008 | 0.02 | tr. | tr. | tr. | 0.014 |
| B-9 | 0.60 | 1.10 | 0.50 | 0.012 | 0.007 | 0.91 | tr. | tr. | tr. | 0.015 |
| B-10 | 0.58 | 0.90 | 0.70 | 0.010 | 0.005 | 0.90 | tr. | tr. | tr. | 0.013 |
| B-11 | 0.62 | 1.50 | 0.50 | 0.012 | 0.006 | 0.90 | tr. | tr. | tr. | 0.012 |
| B-12 | 0.61 | 2.05 | 0.49 | 0.008 | 0.006 | 0.91 | tr. | tr. | tr. | 0.016 |
| B-13 | 0.60 | 2.56 | 0.51 | 0.009 | 0.007 | 0.91 | tr. | tr. | tr. | 0.014 |
| B-14 | 0.61 | 1.10 | 0.52 | 0.010 | 0.006 | 0.80 | tr. | 0.20 | tr. | 0.015 |
| B-15 | 0.59 | 1.08 | 0.50 | 0.011 | 0.008 | 0.90 | tr. | tr. | 0.21 | 0.016 |
| B-16 | 0.52 | 1.46 | 0.87 | 0.008 | 0.008 | 0.75 | tr. | tr. | tr. | 0.014 |
| B-17 | 0.52 | 1.42 | 0.85 | 0.009 | 0.006 | 0.77 | tr. | 0.21 | tr. | 0.015 |

Each steel sheet was heated at 900° C. for 10 min. to dissolve Precipitated carbides in a austenite matrix. The steel sheet was rapidly cooled and then tempered at various temperatures to make the temper hardness constant at HV 430. The tempered steel sheet was subjected to the relaxation test in the same way as that in Example 1. The results are shown in FIG. 1.

FIG. 1 apparently shows that the steels with no added exhibited much lower relaxation ratio as compared with steel without Mo, even when these steel had the same temper-softening resistance. This Mo effect means that the alloying element Mo precipitated as fine $Mo_2C$ in the martensite matrix by the tempering serves as an inhibitor against the dislocation migration.

However, the relaxation ratio is varied over a broad range, even when the treated steels had the same temper hardness. This result means that the high-temperature relaxation resistance of the steel can not be determined by analogy from hardness or tensile strength data at an ambient temperature. It is noticed, from FIG. 1, the general tendency that the relaxation ratio becomes lower as the tempering temperature necessary for obtaining the temper hardness of HV 430 becomes higher. In other wards, the steel having high temper-softening resistance has good high-temperature relaxation resistance.

EXAMPLE 4

Effect of Cr, Si and AI Contents

Each of the steels shown in Table 5 was hot rolled to a sheet of 3.5 mm in thickness, annealed and then cold rolled at a reduction of 35%. The obtained cold rolled steel sheet was of 2.3 mm in thickness. In Table 3, the group-A steels have chemical compositions within the range of the present invention, while the group-B steels are comparative.

TABLE 5

| STEELS USED IN EXAMPLE | | | | | | | | | | | |
|---|---|---|---|---|---|---|---|---|---|---|---|
| STEEL | CHEMICAL COMPOSITIONS (wt. %) | | | | | | | | | | SICR |
| KIND | C | Si | Mn | P | S | Cr | Mo | V | Nb | Al | VALUE |
| A-18 | 0.70 | 1.99 | 0.80 | 0.011 | 0.004 | 0.52 | 0.19 | tr. | tr. | 0.007 | 2.76 |
| A-19 | 0.71 | 2.02 | 0.42 | 0.012 | 0.003 | 0.90 | 0.23 | tr. | tr. | 0.006 | −0.92 |
| A-20 | 0.62 | 1.51 | 0.51 | 0.010 | 0.003 | 0.42 | 0.22 | tr. | 0.20 | 0.008 | 1.84 |
| A-21 | 0.61 | 1.51 | 0.73 | 0.011 | 0.004 | 0.51 | 0.31 | tr. | tr. | 0.007 | 0.94 |
| A-22 | 0.49 | 1.12 | 1.28 | 0.011 | 0.004 | 0.92 | 0.21 | 0.22 | tr. | 0.005 | −4.72 |
| A-23 | 0.60 | 2.11 | 0.55 | 0.012 | 0.005 | 0.32 | 0.22 | tr. | tr. | 0.006 | 4.24 |
| A-24 | 0.59 | 1.55 | 0.70 | 0.011 | 0.004 | 0.51 | 0.31 | 0.21 | 0.11 | 0.008 | 1.10 |
| B-18 | 0.71 | 1.52 | 0.51 | 0.012 | 0.004 | 1.35 | 0.22 | tr. | tr. | 0.009 | −7.42 |
| B-19 | 0.71 | 2.02 | 0.81 | 0.012 | 0.003 | 0.52 | 0.20 | tr. | tr. | 0.028 | 2.88 |
| B-20 | 0.69 | 2.25 | 0.70 | 0.012 | 0.004 | 0.15 | 0.21 | tr. | 0.01 | 0.006 | 7.50 |
| B-21 | 0.82 | 0.21 | 0.36 | 0.012 | 0.004 | 0.01 | tr. | tr. | tr. | 0.007 | 0.74 |
| B-22 | 0.70 | 2.00 | 0.78 | 0.013 | 0.003 | 0.51 | tr. | tr. | tr. | 0.008 | 2.97 |
| B-23 | 0.72 | 0.21 | 0.82 | 0.010 | 0.003 | 0.52 | 0.21 | tr. | tr. | 0.008 | −4.36 |

NOTE:
SICR value = 4 × Si (%) − 10 × Cr (%)

Figure 2:
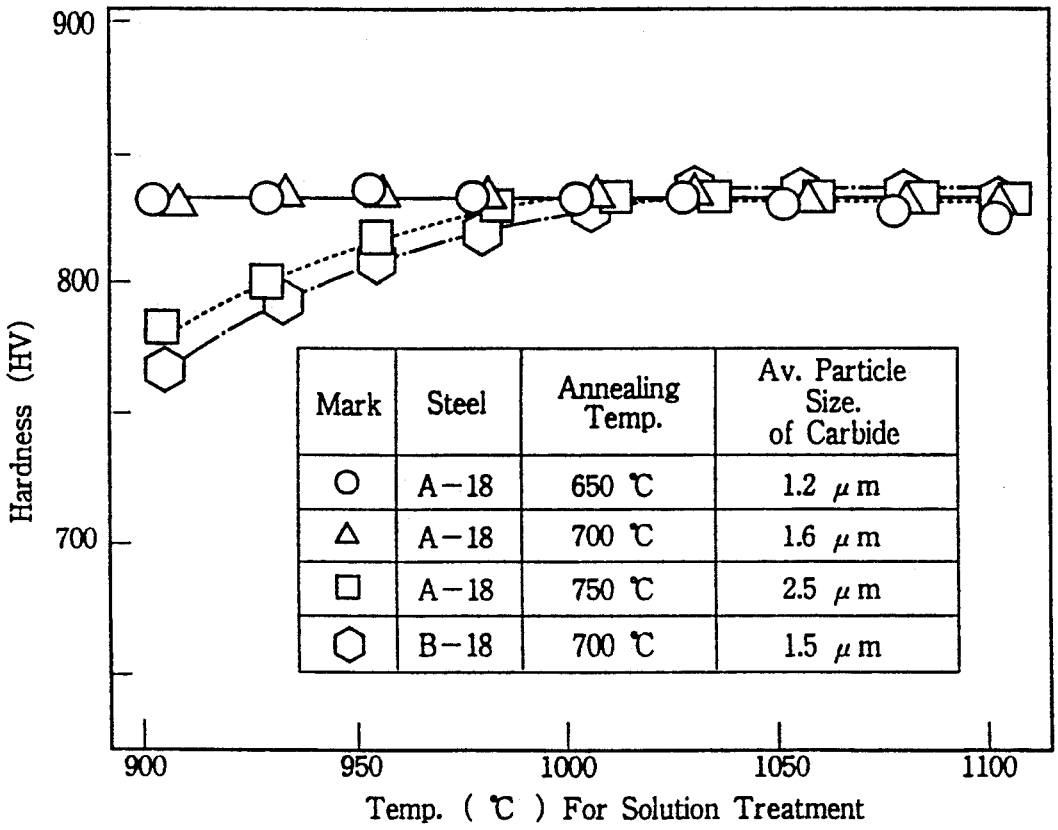
FIG. 2 is a graph showing the relationship between heating temperature and the hardness of steel.

The cold rolled steel sheet was annealed at a temperature within the range of 650°–750° C. for 10 hours to variously change the average particle size of carbides. The annealed sheet was quenched at various quenching temperatures to determined the effect of the quenching temperature on the hardness of the quenched steel. The quenching was performed according to the heat pattern of: rapidly heating up to 850° C. at a heating speed of 140° C./sec., from 850° C. to a test temperature between 900° C. and 1100° C. at a heating speed of 30° C./sec. and then rapidly cooled immediately after the solution treatment without a holding time. The results of the quenching test are shown in FIG. 2.

It is noticed from FIG. 2 that, when the steel A-18 having a composition within the range of the present invention was annealed at a temperature of 650°–700° C., the average particle size of carbides was controlled to below 2 μm. Even when the steel A-18 was heated at the lowest temperature 900° C., the hardness of the quenched steel was the highest level. On the other hand, the same steel A-18 which was annealed at 750° C. had an average particle size of carbides above 2 μm, and the hardness of the steel after being quenched did not reach the highest level unless the quenching temperature was elevated up to 950° C.

The comparative steel B-18 had SICR value of −7.42 out of the range of the present invention. After the steel B-18 was annealed, the extreme concentration of Cr was detected in carbides. Consequently, it was necessary that the steel B-18 be heated up to 1000° C. in order to obtain the higher hardness, although the average particle size of carbides was below 2 μm.

From the comparison, it is apparent that carbides can be rapidly dissolved in the austenite matrix at a relatively lower temperature according to the present invention.

Each of the cold rolled steel sheet of 2.3 mm in thickness was annealed at 680° C. for 10 hours, heated to 900° C., quenched in oil and then tempered at various temperatures for 30 min. The quench-tempered steel was used for examining the fatigue and relaxation properties.

The fatigue test was performed as alternating plane bending fatigue. The results are shown in Table 6.

TABLE 6

| QUENCHABILITY OF STEELS | | | | | |
|---|---|---|---|---|---|
| STEEL KIND | TEMPERING TEMP. (°C.) | HARDNESS (HV) | TESTING TEMP. (°C.) | FATIGUE STRENGTH (kgf/mm²) | NOTE |
| A-18 | 580 | 454 | 25 | 52 | PRESENT |
| | | | 250 | 51 | INVENTION |
| | 540 | 490 | 25 | 57 | |
| A-24 | 550 | 452 | 25 | 53 | |
| | | | 250 | 51 | |
| | 500 | 505 | 25 | 56 | |
| B-18 | 580 | 448 | 25 | 47 | COMPARATIVE |
| | | | 250 | 46 | EXAMPLE |
| B-19 | 590 | 452 | 25 | 43 | |
| | | | 250 | 41 | |

It is noticed from Table 4 that the steel A-15 of the present invention, after being quench-tempered had a hardness approximately equal to that of the comparative steel B-19, but that the steel A-18 was superior to the steel B-19 in fatigue strength at both 20° C. and 250° C. This is caused by the fact that the amount of hard inclusions causing fatigue failure was small in the steel A-18, since Al content of the steel A-18 was less than 0.020%. The steel A-24 exhibited the same fatigue property.

The Cr content in the comparative steel B-20 was smaller as compared with Si content, so that the SICR value was 7.50, that is out of the range of the present invention. Since graphite particles were easily formed during annealing the steel B-20, it took a long time to dissolve the formed graphite in the austenite matrix during solution treatment. Due to the long-time solution treatment, the steel B-20 was significantly decarburized. As a result, the steel B-20 had fatigue strength which was inferior to those of the steels A-18 and A-24.

Each test piece was examined by a relaxation test. During the relaxation test, the test piece was held at 350° C. under an initial strain of 1.0% for 10 hours. The reduction ratio of load after the test is regarded as its relaxation ratio in Table 7.

TABLE 7

HIGH-TEMPERATURE RELAXATION RESISTANCE OF STEEL

| STEEL KIND | QUENCHING TEMP. (°C.) | TEMPERING TEMP. (°C.) | HARDNESS (HV) | RELAXATION RATIO (%) | NOTE |
|---|---|---|---|---|---|
| A-18 | 900 | 580 | 454 | 12.4 | PRESENT INVENTION |
| | | 540 | 490 | 12.2 | |
| A-19 | 900 | 580 | 461 | 13.1 | |
| | | 540 | 494 | 13.1 | |
| A-20 | 900 | 520 | 471 | 16.3 | |
| A-21 | 900 | 540 | 469 | 12.0 | |
| | | 510 | 495 | 11.9 | |
| A-22 | 900 | 520 | 435 | 17.3 | |
| A-23 | 900 | 560 | 455 | 12.5 | |
| A-24 | 900 | 550 | 452 | 11.5 | |
| | | 500 | 505 | 11.3 | |
| B-21 | 850 | 430 | 450 | 36.7 | COMPARATIVE EXAMPLE |
| | 850 | 400 | 475 | 38.5 | |
| B-22 | 900 | 550 | 459 | 31.5 | |
| B-23 | 880 | 490 | 465 | 25.2 | |

The comparative steel B-21 having the composition corresponding to SK5 showed extremely high relaxation ratio. The comparative steel B-22 which did not contain Mo and the comparative steel B-23 wherein Si content was smaller as compared with Mo content were tempered at a relatively lower temperature to assure strength necessary for spring, so that carbides such as $MO_2C$ effective in high-temperature relaxation resistance were not precipitated in the steel matrix. Consequently, none of the group-B steels showed low relaxation ratios.

On the other hand, the group-A steels showed very low relaxation ratio, i.e. excellent in high-temperature relaxation resistance.

EXAMPLE 5

Effect of Tempering Temperature

Steels shown in Table 8 were used in this Example. In Table 8, the group-A steels have the compositions within the range of the present invention, while the group-B steels are for comparison.

TABLE 8

STEELS USED IN EXAMPLE

| STEEL KIND | CHEMICAL COMPOSITIONS (wt. %) | | | | | | | | | |
|---|---|---|---|---|---|---|---|---|---|---|
| | C | Si | Mn | P | S | Cr | Mo | V | Nb | Al |
| A-25 | 0.58 | 1.65 | 0.73 | 0.011 | 0.005 | 0.95 | 0.21 | tr. | tr. | 0.007 |
| A-26 | 0.61 | 1.69 | 0.73 | 0.012 | 0.004 | 0.97 | 0.22 | 0.22 | tr. | 0.006 |
| A-27 | 0.59 | 1.66 | 0.73 | 0.010 | 0.003 | 0.96 | 0.22 | tr. | 0.19 | 0.006 |
| A-28 | 0.63 | 1.12 | 0.71 | 0.012 | 0.002 | 0.32 | 0.32 | 0.20 | 0.10 | 0.008 |
| A-29 | 0.71 | 2.01 | 0.52 | 0.016 | 0.004 | 0.51 | 0.23 | tr. | tr. | 0.009 |
| A-30 | 0.72 | 2.21 | 1.52 | 0.012 | 0.004 | 1.21 | 0.21 | tr. | tr. | 0.007 |
| A-31 | 0.70 | 1.01 | 0.53 | 0.011 | 0.002 | 0.53 | 0.21 | 0.12 | tr. | 0.007 |
| B-24 | 0.32 | 1.02 | 0.74 | 0.014 | 0.003 | 0.95 | 0.23 | tr. | tr. | 0.007 |
| B-25 | 0.70 | 2.03 | 0.71 | 0.011 | 0.004 | 0.53 | 0.21 | tr. | tr. | 0.031 |
| B-26 | 0.62 | 0.21 | 0.81 | 0.013 | 0.002 | 0.93 | 0.21 | tr. | tr. | 0.006 |
| B-27 | 0.62 | 1.59 | 0.71 | 0.011 | 0.003 | 0.92 | 0.01 | tr. | 0.01 | 0.008 |
| B-28 | 0.85 | 0.25 | 0.40 | 0.011 | 0.003 | 0.02 | tr. | tr. | tr. | 0.008 |

Each steel in Table 8 was hot rolled to a thickness of 3.5 mm, annealed and then cold rolled to a thickness of 2.3 mm at a reduction of 35%. The cold rolled steel sheet was annealed at 680° C. for 10 hours. Thereafter, the sheet was heated at a temperature between 850°-900° C., above its $Ac_3$ transition point, for 10 min., quenched in oil and then tempered for 30 min. The tempering was done at various temperatures to examine the effect of the hardness of the tempered steel on its relaxation ratio.

The quench-tempered steels A-25, A-29, A-30, B-25 were polished by Emery cloth #500 and subjected to fatigue and relaxation tests. The fatigue test was performed as alternating plane bending fatigue. The results are shown in Table 9.

TABLE 9

EFFECT OF TEMPERING TEMPERATURE ON FATIGUE PROPERTY

| STEEL KIND | QUENCHING TEMP. (°C.) | TEMPERING TEMP. (°C.) | HARDNESS (HV) | TESTING TEMP. (°C.) | FATIGUE STRENGTH ($kgf/mm^2$) | NOTE |
|---|---|---|---|---|---|---|
| A-25 | 900 | 540 | 463 | 25 | 51 | PRESENT INVENTION |

TABLE 9-continued

EFFECT OF TEMPERING TEMPERATURE ON FATIGUE PROPERTY

| STEEL KIND | QUENCHING TEMP. (°C.) | TEMPERING TEMP. (°C.) | HARDNESS (HV) | TESTING TEMP. (°C.) | FATIGUE STRENGTH (kgf/mm²) | NOTE |
|---|---|---|---|---|---|---|
| | | 480 | 508 | 25 | 58 | " |
| | | 410 | 573 | 25 | 47 | COMPARATIVE EXAMPLE |
| A-29 | 900 | 580 | 452 | 25 | 51 | PRESENT INVENTION |
| | | | | 250 | 50 | " |
| | | 510 | 516 | 25 | 57 | " |
| | | 440 | 578 | 25 | 47 | COMPARATIVE EXAMPLE |
| B-25 | 900 | 580 | 448 | 25 | 46 | COMPARATIVE STEEL |
| | | | | 250 | 44 | " |

It is apparent from Table 9 that the steel A-29 had a fatigue strength superior to that of the steel B-25 at both room temperature (25° C.) and 250° C., although these steels had approximately the same hardness after being quench-tempered. This is caused by the fact that the amount of hard inclusions causing fatigue failure was made smaller in the steel A-29, since its Al content was below 0.020%. The fatigue strength was not only determined by the chemical composition but also by the temper hardness. For instance, the fatigue strength became lower with an increase of the temper hardness above HV 550.

Figure 3:
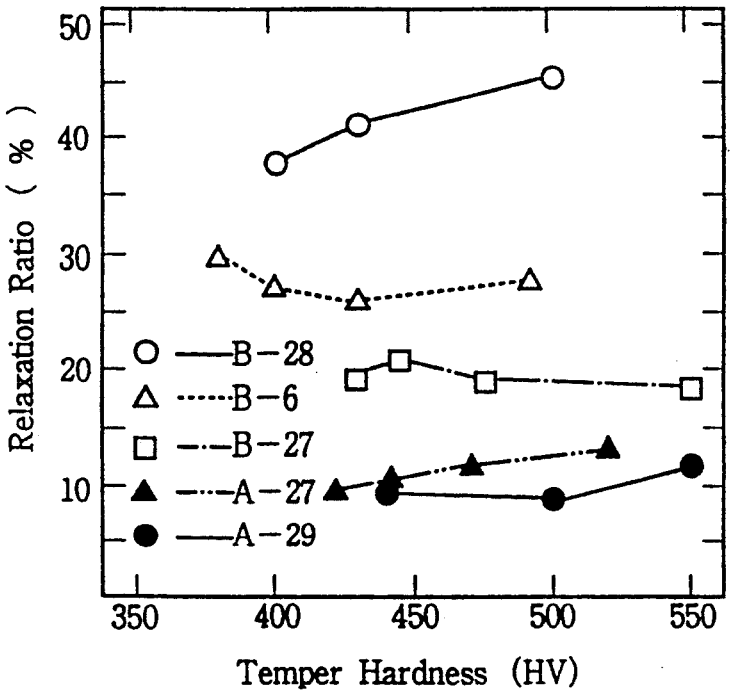
FIG. 3 is a graph showing the effect of temper hardness on relaxation ratio.

For the relaxation test, each test piece was held at 350° C. under an initial strain of 1.0% for 12 hours. The reduction ratio of load after the test is indicated as relaxation ratio in Table 10, and the relationship between the temper hardness and the relaxation ratio is shown in FIG. 3.

TABLE 10

EFFECT OF TEMPERING TEMPERATURE ON RELAXATION PROPERTY

| STEEL KIND | QUENCHING TEMP. (°C.) | TEMPERING TEMP. (°C.) | HARDNESS (HV) | RELAXATION RATIO (%) | NOTE |
|---|---|---|---|---|---|
| A-25 | 900 | 480 | 496 | 16.2 | PRESENT |
| | | 520 | 475 | 15.1 | INVENTION |
| | | 560 | 452 | 14.4 | |
| | 850 | 520 | 462 | 15.7 | |
| A-26 | 900 | 560 | 470 | 13.5 | |
| A-27 | 900 | 520 | 470 | 15.7 | |
| A-28 | 900 | 440 | 509 | 16.1 | |
| | | 480 | 491 | 15.9 | |
| | | 520 | 465 | 15.2 | |
| | 850 | 520 | 449 | 16.2 | |
| A-29 | 900 | 580 | 453 | 12.5 | |
| A-30 | 900 | 580 | 472 | 11.1 | |
| A-31 | 900 | 520 | 446 | 13.6 | |
| B-24 | 900 | 520 | 348 | 40.2 | COMPARATIVE |
| B-27 | 880 | 520 | 427 | 32.5 | EXAMPLE I |
| B-28 | 850 | 430 | 450 | 36.7 | |
| A-25 | 900 | 650 | 391 | 22.1 | COMPARATIVE |
| A-28 | 900 | 620 | 382 | 23.1 | EXAMPLE II |
| A-29 | 900 | 660 | 392 | 23.2 | |
| A-31 | 900 | 620 | 378 | 25.1 | |

The comparative steels B-24 and B-26 had high relaxation ratio due to small C and Si contents. The comparative steel B-27 had extremely high relaxation ratio, since it did not contain Mo to be precipitated as $Mo_2C$ effective in high-temperature relaxation resistance.

The relaxation was effected by the tempering temperature, too. When the steels A-25, A-28, A-29 and A-31 having chemical compositions within the range of the present invention were tempered at higher temperature, their temper hardness became lower than HV 400 (see COMPARATIVE EXAMPLE II). Consequently, the relaxation ratio was not reduced so much.

On the other hand, when the steels having the chemical compositions within the range of the present invention were tempered under the controlled tempering condition, the tempered steels had relaxation ratios which were extremely lower than the results of COMPARATIVE EXAMPLE II. Consequently, the steels obtained according to the present invention were excellent in high-temperature relaxation resistance.

It is noticed from FIG. 3 that the relaxation ratio is slightly lowered when there is a decrease of the temper hardness. This relationship means that the high-temperature relaxation resistance can not be estimated from the strength or hardness at ambient temperature. That is, the high-temperature relaxation is quite different from the relaxation at ambient temperature. The relaxation resistance at ambient temperature depends on temper hardness, and relaxation ratio becomes lower with an increase of the hardness. On the contrary, the high-temperature relaxation resistance does not have an intimate relationship with the temper hardness.

According to the present invention as aforementioned, spring steel excellent in high-temperature relaxation resistance is obtained by the combination of controlled chemical composition with controlled heat treatment. The steel spring obtained in this way keeps its properties stable, even when incorporated in various equipment to be exposed to a high-temperature atmosphere.

While the preferred embodiment and examples of the present invention have been shown and described, it is to be understood that these disclosures are for the purpose of illustration and that various changes and modifications may be made without deviating from the scope of the invention as set forth in the appended claims.

What is claimed is:

1. A method of manufacturing a spring steel, which has excellent high-temperature relaxation resistance, which comprises the steps of:

providing a steel consisting essentially of, each by weight, 0.4–0.8% C, 0.5–2.5% Si, 0.3–2.0% Mn, 0.1–1.5% Cr, 0.1–0.5% Mo, and the balance being Fe except inevitable impurities;

hot rolling said steel;

annealing said hot rolled steel sheet;

subjecting said annealed steel sheet to at least one cycle of cold rolling at a reduction of 10–80% and annealing said steel at a temperature below its $Ac_1$, transition point, to precipitate fine spheroidal carbide particles in said steel;

heating said annealed steel sheet, at a temperature above its $Ac_3$ transition point, for a time sufficient to substantially dissolve said spheroidal carbides in an austenite matrix;

rapidly cooling said heated steel sheet at a lower critical cooling speed to a degree sufficient to substantially completely transform the steel matrix in said steel sheet to a martensite state oversaturated with carbon;

tempering said cooled steel sheet, at a temperature of about 450°–600° C. for a time sufficient to precipitate fine Mo2C particles in the martensite matrix; and then cooling said tempered steel sheet to room temperature.

2. The method according to claim 1, where the Al residual deoxidizing agent content in said steel is less than 0.020%.

3. The method according to claim 1, wherein the Si content in said steel is 1.5–2.5%.

4. The method according to the claim 1, wherein said steel contains at least one of 0.05–0.5% V and 0.05–0.5% Nb.

5. A method for manufacturing a spring steel, excellent in quenchability and high-temperature relaxation resistance, which comprises the steps of:

providing a steel consisting essentially of, each by 0.4–0.8% C, 0.5–2.5% Si, 0.3–2.0% Mn, 0.1–1.5% Cr, 0.1–0.5% Mo, and the balance being Fe except inevitable impurities, wherein:

$$-7 \leqq 4 \times Si(\%) - 10Cr(\%) \leqq 5;$$

which method comprises:

hot rolling said steel;

annealing said hot rolled steel sheet;

subjecting said annealed steel sheet to at least one cycle of cold rolling at a reduction of 10–80% and annealing at a temperature of about 550°–730° C. for a time sufficient to precipitate spheroidal carbides of about 2 μm or less in average particle size;

heating said annealed steel sheet at a temperature above its $Ac_3$ transition point for a time sufficient to substantially dissolve said spheroidal carbides in an austenite matrix;

rapidly cooling said heated steel sheet at a lower critical cooling speed to an extent sufficient to completely transform the steel matrix in said heated steel sheet to a martensite state oversaturated with carbon;

tempering said cooled steel sheet at a temperature of about 450°–600° C. for a time sufficient to precipitate fine $Mo_2C$ particles in the martensite matrix; and then cooling the tempered steel sheet to a room temperature.

6. The method according to claim 5, wherein said steel contains at least one of 0.05–0.5% V and 0.05–0.5% Nb.

7. The method according to claim 5, where Al included as a residual deoxidizing agent in said steel is present in a proportion of less than 0.020%.

8. The method according to claim 5, wherein the Si content in said steel is 1.5–2.5%.

9. A method for manufacturing a spring steel, excellent in quenchability and high-temperature relaxation resistance, which comprises the steps of:

providing a steel consisting essentially of, each by weight, 0.4–0.8% C, 0.5–2.5% Si, 0.3–2.0% Mn, 0.1–1.5% Cr, 0.1–0.5% Mo, and the balance being Fe except inevitable impurities;

hot rolling said steel;

annealing said hot rolled steel sheet;

subjecting said annealed steel sheet to at least one cycle of cold rolling at a reduction of 10–80% and annealing at a temperature below its $Ac_1$, transition point, to precipitate fine spheroidal carbides;

heating said annealed steel sheet at a temperature above its $Ac_3$ transition point for a time sufficient to substantially dissolve said spheroidal carbides in an austenite matrix;

rapidly cooling said heated steel sheet at a lower critical cooling speed under conditions sufficient to completely transform the steel matrix in said steel sheet to a martensite state oversaturated with carbon;

tempering said cooled steel sheet at a temperature condition to adjust temper hardness to about HV 400–550; and then cooling said tempered steel sheet to a room temperature.

10. The method according to claim 9, including providing less than 0.020% Al in said steel.

11. The method according to claim 9, wherein said steel contains at least one of 0.05–0.5% V and 0.05–0.5% Nb.

12. The method according to claim 9, wherein the Si content in the steel is 1.5–2.5%.

* * * * *